United States Patent [19]

Harunari

[11] 4,012,931

[45] Mar. 22, 1977

[54] TUMBLER LOCK

[75] Inventor: Kouichi Harunari, Kagoshima, Japan

[73] Assignee: Kokusan Kinzoku Kogyo Kabushiki Kaisha, Tokyo, Japan

[22] Filed: Jan. 13, 1976

[21] Appl. No.: 648,705

[52] U.S. Cl. ..... 70/363; 70/386; 70/419

[51] Int. Cl.[2] ..... E05B 27/08

[58] Field of Search ..... 70/363, 386, 362, 419, 70/421

[56] References Cited

UNITED STATES PATENTS

| | | | |
|---|---|---|---|
| 2,036,747 | 4/1936 | Fitzgerald | 70/363 |
| 3,733,863 | 5/1973 | Toepfer | 70/363 |

*Primary Examiner*—Robert L. Wolfe
*Attorney, Agent, or Firm*—Sughrue, Rothwell, Mion, Zinn & Macpeak

[57] ABSTRACT

A tumbler lock comprises a rotatable cylinder member formed with a plurality of bottomed holes arranged in parallel along an axis of the rotatable member on a circle coaxial with the axis, a corresponding number of biasing springs disposed in the bottoms of the respective holes, a corresponding number of tumbler pins each formed with annular groove at a different axial position and inserted into different one of the holes against a biasing spring and a cylindrical stationary member for rotatably holding the rotatable member, wherein the rotatable cylinder member is formed with the corresponding number of radial holes each communicated with corresponding one of the bottomed holes and, wherein a corresponding number of recesses are formed on the inner surface of the stationary member at positions corresponding to the radial holes and wherein a corresponding number of balls are provided for each of the tumbler pins in the rotatable member in such a manner that, in a normal state, the rotation of the rotatable member relative to the stationary member is prevented by the balls engaged between the recesses formed in the inner surface of the stationary member and the radial holes of the rotatable member and, in operation, the relative rotation is permitted by the balls received in the annular grooves of the tumbler pins.

4 Claims, 6 Drawing Figures

TUMBLER LOCK

BACKGROUND OF THE INVENTION

1. Field of the Invention

The present invention relates to a cylinder lock, and, particularly, to a cylinder lock of the type having parallel tumbler pins arranged on a circle coaxial with an axis of the lock.

2. Description of the Prior Art

There are two types of the cylinder locks, one having a rotatable cylinder in which a plurality of tumblers are arranged in the axis direction and the other having a rotatable cylinder in which a plurality of tumblers are arranged on a circle coaxial with the axis. In either case, a pair of pins are provided in each of holes of the two members to be registered at fixed position and by inserting a key thereinto, the tumblers in the rotatable member are shifted axially whereby contact portions of two or more tumblers in the respective holes are simultaneously registered with the contact planes of the stationary member and the rotatable member of the lock to thereby permit rotation relatively between the two members.

Therefore, the number of parts of the conventional cylinder lock such as above is large. And, particularly, when the preciseness of machining of the parts is relatively low, the possibility of undesirable unlocking thereof such as picking is increased because the plurality of the tumblers are inserted into the respective holes. Particularly, the above disadvantages become remarkable for the lock of the type in which the tumblers are arranged axially of the rotatable cylinder. By arranging the tumblers in radial directions, the possibility of the picking may be lowered. However, the latter arrangement renders the structure of the lock complicated.

SUMMARY OF INVENTION

An object of the present invention is to provide a cylinder lock in which it is sufficient to arrange only one tumbler in each hole of the cylinder and by which the possibility of undesired relief can be minimized.

Another object of the present invention is to provide a cylinder lock which has a structure by which the tumblers can be provided in the peripheral portion of the rotatable cylinder to obtain a useful space in the end face of the rotary cylinder to thereby provide further tumblers in the end face. Thus a larger number of key variations than the conventional can be available in this cylinder lock.

Preferred embodiments of the present invention will be described hereinafter with reference to the attached drawing.

DESCRIPTION OF THE EMBODIMENT

Figure 1A:
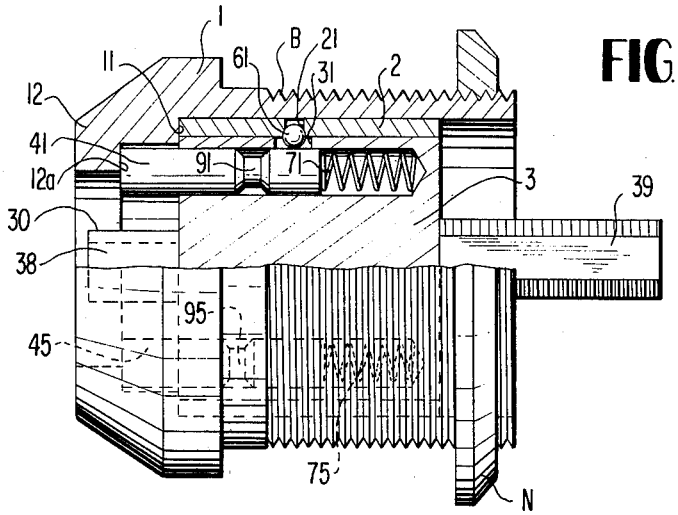
FIG. 1A is a partially removed side view of a first embodiment of the present invention showing the main portion of the cylinder lock.

In FIG. 1A, a cylinder lock according to the present invention includes a cylindrical casing 1 into which a sleeve 2 is inserted. One end face of the sleeve 2 butts against a shoulder 11 provided on an inner surface of the casing 1 and the other end of the sleeve 2 is secured to the casing by a suitable means such as caulking etc. to prevent relative movement therebetween.

Figure 2:
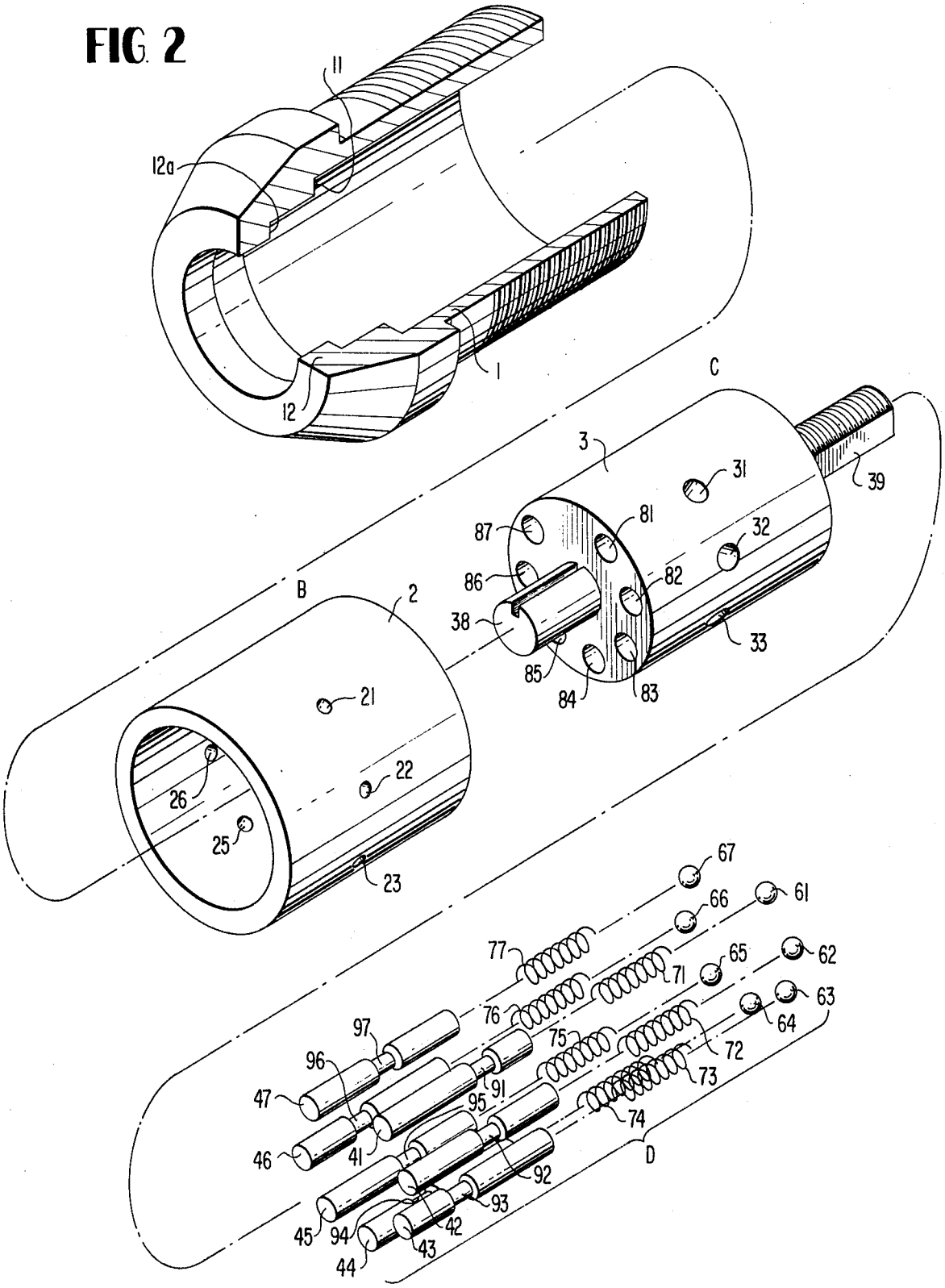
FIG. 2 is a perspective view of disassembled cylinder lock shown in FIG. 1.

A plurality of radial holes such as 21, 22, 23, 24, 25, 26 and 27 are provided peripherally in suitable positions spaced circumferentially the sleeve 2. The diameter of each of the radial holes is smaller than the diameter of a ball which will be described later. Although radial holes are employed in the embodiment in FIG. 2, it may be possible to employ recesses instead of the radial holes.

A cylindrical member 3 is rotatably inserted into the sleeve 2. The cylindrical member 3 is provided integrally at one end thereof with a key pilot post 38 and integrally at the other end thereof with an extension 39 for securing a lock operating plate (not shown) thereto. The extension 39 may be formed by machining the other end portion of the cylindrical member to reduce the diameter thereof and providing a thread thereon.

As shown in FIG. 1A, when the cylindrical member 3 is rotatably inserted into the sleeve 2 and the latter into the casing 1 a peripheral portion of the one end face of the cylindrical member 3 i.e., the face on which the pilot post is formed, butts against the shoulder 11 of the cylindrical casing 1 and the other end face on which the extension 39 is provided is supported by a suitable known means such as a washer or an annular nut etc. not shown such that it is ratatable in the sleeve 2 but can not be substantially shifted in an axial direction.

The cylindrical member 3 is provided on the periphery thereof with a plurality of ball receiving radial holes ( in the embodiment seven holes are employed and, in FIG. 2, only three holes 31 to 33 are shown) and, on the face of the member 3 on which the pilot post 38 is provided, a plurality of bottomed axial holes of which 81, 82, 83, 84 and 87 are shown and are provided in parallel with the axis of the member 3, the positions of these holes 81 to 87 being on a circle coaxial to the cylinder member and corresponding to those of the holes 31, 32, 33, respectively. The diameter of each of the radial holes 31 etc. is larger than the diameter of the balls to be employed therewith so that a ball can be freely move in each of the radial holes 31 etc. in the radial direction of the cylinder member 3.

Into the axial holes 81 etc. there is provided in the cylinder member 3, tumbler pins 41 to 47 which are formed at different intermediate portions with annular grooves 91 to 97, respectively, the pins being inserted against biasing springs 71 to 77, respectively. The size of each of the annular grooves 91 to 97 is selected such that when the balls 61 to 67 are put therein the balls protrude from the outer surface of the tumbler pin by at least the radius thereof.

As described hereinbefore, since there are provided springs 71 to 77 in the bottom of respective axial tumbler holes when the cylinder member 3 is inserted into the sleeve 2, the tumbler pins are biased leftwardly in FIG. 1A.

Figure 1B:
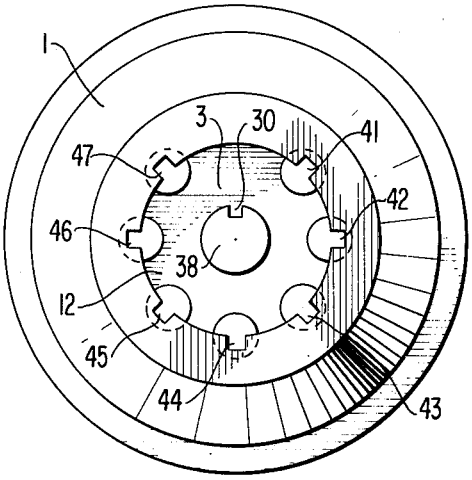
FIG. 1B is an end view of the embodiment shown in FIG. 1A.

The casing 1 is formed at one end thereof with an annular flange 12. In an assembled state, a portion of the end of each of the tumbler pins butts a shoulder 12a formed in the inside of the flange portion of the casing 1 and the remaining area of the end is exposed as shown in FIG. 1B.

As will be clear from the foregoing description, in the normal state, the respective tumbler pins 41 to 47 are held in position by the flange portion 12 and the biasing force due to the springs 71 to 77 as shown in FIG. 1, in the state shown in FIG. 1, the ball receiving holes formed in the sleeve 2 are registered with the holes formed in the side face of the cylinder member 3, and the annular grooves 92 to 97 formed on the respective tumbler pins 41 to 47 are at different axial position respect to each other. There are provided, in the radial holes of the cylinder member 3, balls 61 to 67 respectively such that the major part of each ball is in the respective radial hole 31, etc., and only a portion of the ball is received in the ball receiving holes 21 etc. in the sleeve 2 which, as mentioned previously, is smaller in size than the ball. That is, in the state shown in FIG. 1, the respective balls are partially positioned in the radial holes 31 etc. and supported by the sleeve 2 which is the stationary portion of the lock and by the outersurface or periphery of the tumbler pins. Therefore, there is no relative rotation between the sleeve 2 and the cylinder member 3 and thus a locking condition is established.

Figure 3:
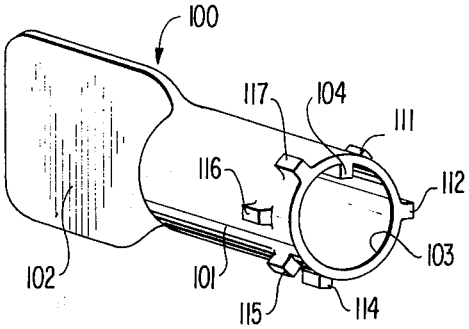
FIG. 3 is a perspective view of a key for the cylinder lock.

In order to operate the lock, a key such as shown in FIG. 3 may be used. In FIG. 3, the key 100 comprises a hollow cylinder portion 101 and an operating or handle portion 102. The inner diameter of the hollow cylinder is made slightly larger than the diameter of the pilot post 38 of the cylinder member 3 so that the key 100 can be telescoped onto the pilot post and the hollow cylinder portion is formed with a radially inwardly projecting drive lug 104 on the inner periphery thereof. The width and height of the drive lug is made smaller than those of an axial groove 30 formed within the outer surface of the pilot post 38.

On the outer periphery of the cylinder portion 101, radially outwardly projecting push pins 111 to 117 are formed. The peripheral positions of the push pins are registered with the tumbler pins 41 to 47 of the lock and the axial positions corresponds to compensate for the differences in position of the annular grooves 91 to 97. Accordingly, when the cylinder portion 101 of the key 100 is inserted into a space formed between the inner edge of the flange 12 and the outer surface of the pilot post 38 with the relation of the drive lug 104 thereof to the groove 30 of the pilot post being mated, until the end of the cylinder portion 102 abuts the end face of the cylinder member 3, the push pins 111 to 117 respectively engage the end faces of the tumbler pins 41 to 47 causing the latter to be pushed inwardly against the springs 71 to 77 respectively. By further pushing the key into the space, the tumbler pins are further pushed inwardly and ultimately reach positions at which the respective annular grooves 91 to 97 coincide with the positions of the balls 61 to 67, respectively and the balls shift into the respective grooves. Then, by turning the key 100, a torque is exerted on the cylinder member 3 through the engagement between the drive lug 104 and the axial groove 30.

As mentioned previously, since the balls in the normal state are received partially in the radial holes 31 etc. of the cylinder member 3 and the remaining portions of the balls are in engagement with the holes 21 etc. of the sleeve 2, balls 61 to 67 are subjected to forces causing them to move radially inwardly of the cylinder member 3 due to the shearing force produced between the outer surface of the cylinder member 3 and the inner surface of the sleeve 2 by the torque provided by the turning of the key. As a result, the balls are shifted from the positions between the cylinder member 3 and the sleeve 2 to the positions between the cylinder member 3 and the annular grooves 91 to 97 respectively. Therefore, the locking condition between the sleeve 2 and the cylinder member 3 which is established by the balls is relieved and the cylinder member 3 is permitted to turn with respect to the sleeve 2. The extension portion 39 of the cylinder member 3 rotates with the rotation of the cylinder member 3. A locking plate, not shown, is fixedly attached to the extension portion 39, which serves to release the locking mechanism.

Figure 4:
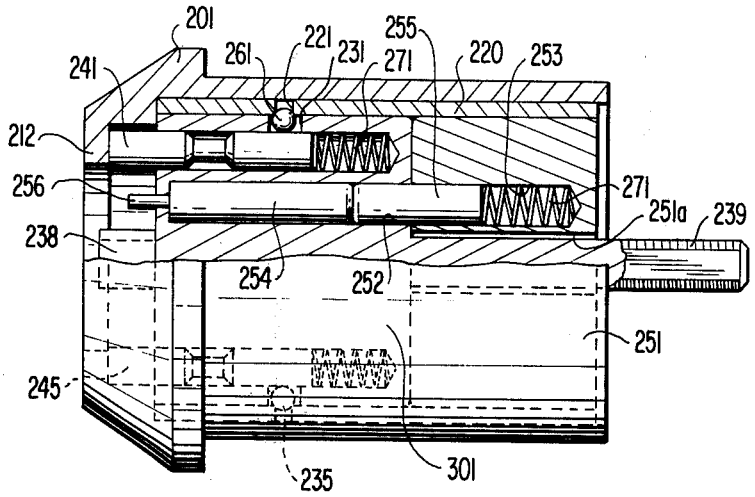
FIG. 4 is a second embodiment of the present invention showing a partially removed side view.

Another embodiment shown in FIG. 4 will be described hereinafter. In FIG. 4, in a hollow casing 201, a sleeve 220 having a plurality of holes 221 etc. whose diameter is smaller than the diameter of the ball are secured in the same manner as in the previous embodiment. In the sleeve, a cylinder member 301 is inserted such that the latter can not be moved in the axial direction but is rotatable with respect to the sleeve. On the outer side surface of the cylinder member 301, holes 231 etc. are formed in the same manner as in the previous embodiment. Each of the holes 231 etc. are sized in such a manner that at the positions registered with the holes 221 etc., in locking condition, each has a diameter larger than that of the ball so that the major portion of the ball can freely rotatably received therein. A plurality of holes which receive slidably the tumbler pins 241 to 247 are further provided in the cylinder member 301.

On the inner wall of each tumbler receiving hole, a recess 291 is provided at a different axial position from that of the hole 231. Since the respective tumbler 241–247 are biased by the springs 271–277, the tumblers in the normal state tends to move leftwardly to thereby abut the inner surface of the flange portion 212 formed in the casing 201 as in the first embodiment.

In the second embodiment, another tumbler mechanism comprising a suitable number of further tumblers each composed of two series pins is provided to increase the variation of combination. That is, as shown in FIG. 4, a second cylinder member 251 having a center hole 251a is provided behind the cylinder member 301 in the sleeve 220. The second cylinder member 251 is secured to the sleeve 220 by suitable means such as caulking, radial pin etc. Shouldered through holes 252 are formed in the cylinder member 301, bottomed holes 253 are formed in the cylinder member 251, the latter holes having the same diameter as that of the through holes 252 and pairs of holes 252 and 253 are registered in the normal state. A pin 254 which is slidably housed in one cylinder 301, another pin 255 is mainly slidably housed in aligned hole 253. The pin 254 is provided at a remote end from the pin 255, with a reduced diameter portion 256. A shoulder of the pin 254 formed by the reduced portion abuts a shoulder at the left end of the hole 252.

Therefore, in the normal state, the two pins 254 and 255 in one tumbler hole are registered and urged by the spring 235 against the shoulder of the hole 252 with the end portion of the diameter portion 256 being beyond the end of the cylinder member 301. The lengthes of the pins 254 and 255 are selected such that, in the normal state, the contact point of the pins is shifted from the contact plane between the cylinder member 301 and 251 and the degree of shift is different from those of other pairs of pins.

Figure 5:
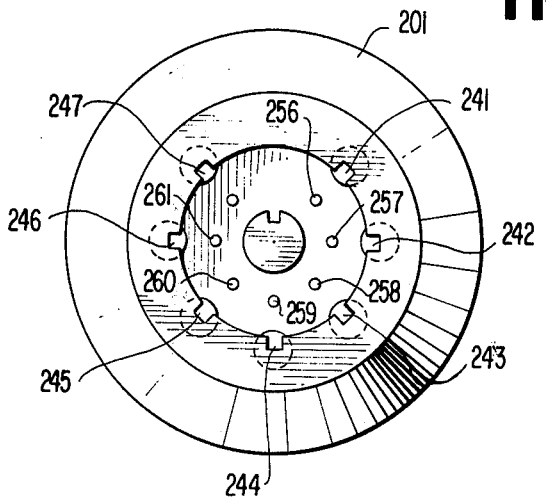
FIG. 5 is an end view of the second embodiment shown in FIG. 4.

FIG. 5 shows an end view of the embodiment in FIG. 4. As seen from FIG. 5, the further tumbler mechanism comprises six tumblers whose reduced diameter pin portions 256–261 disposed as shown. The six tumblers are substantially identical except for the contact point of the two pins in each hole of the cylinder member 301.

In order to operate the lock in FIG. 4, a key similar to the key 100 in FIG. 3 may be used in the manner previously mentioned. However, the key to be used in the second embodiment is further formed with push pins for pushing the reduced diameter pin portions 256 etc. That is, the lock in FIG. 4 can be operated only when the balls engaged with the recesses of the sleeve 220 are moved inwardly into the annular grooves thereof by pushing the tumbler pins 241–247 and, concurrently, the contact points of all of the pins are moved to the contact plane between the cylinder members 301 and 251 by pushing the reduced portions of the pins. Therefore, the key must be provided with push pins for pushing the reduced portions 256 as well as push pins for pushing the tumbler pins 241–247.

By using such key as above and forcing it into the lock, the cylinder member 301 is permitted to rotate when turned and the turning is transmitted through the extension 239 which passes through the center hole of the member 251 to the operating plate (not shown) fixedly secured to the extension 239 of the cylinder member 301 by which the locking and unlocking operation of the lock is performed.

Two preferred embodiments of the present invention have been described. However, the present invention is not limited by these embodiments and many modifications thereof may be made within the scope of the present invention. For example, the cross-sectional shape of the various tumbler pins 41 and 241 may be rectangular or of other shape than circular in the embodiments.

What is claimed is:

1. A tumbler lock, comprising:

a hollow cylinder casing, a sleeve concentrically received within said casing and secured thereto, a cylinder member rotatably supported within said sleeve and coaxial therewith, the improvement comprising:

a first tumbler mechanisms including a plurality of circumferentially spaced holes at a common axial position within at least the inner peripheral surface of said sleeve, a corresponding number of radially extending, circumferentially spaced holes of somewhat larger diameter at positions within said cylinder member corresponding to the holes of said sleeve, bottomed holes extending longitudinally within said cylinder parallel to its axis from one end thereof and intersecting said radially extending holes within said cylinder, a biasing spring in the bottom of, each bottomed hole within said cylinder member, a tumbler pin slidably mounted within a corresponding bottomed hole, said tumbler pins being formed with an annular groove at different axial positions, a ball of a diameter less than the diameter of the radially extending holes within said cylinder member but greater than the diameter of the corresponding holes within the sleeve positioned within each radial hole of said cylinder member such that in a normal state, said ball engages a respective hole of said sleeve while being partially positioned within the hole of said cylinder member to prevent relative rotation of said cylinder member and said sleeve, and a plurality of second tumbler mechanisms arranged coaxial within said cylinder member at radial positions closer to the axis of said cylinder member than said first tumbler mechanisms and operatively engaging said sleeve and said cylinder member such that, by insertion of a key into said lock and turning it, said balls are aligned with the annular grooves of said tumbler pins of said first tumbler mechanism and are disengaged from the holes of said sleeve and said second tumbler mechanisms are shifted axially to a position to release said cylinder member with respect to said sleeve to permit relative rotation between said cylinder member and said sleeve.

2. A tumbler lock comprising:

a hollow cylinder casing, a sleeve concentrically received within said casing and secured thereto, a cylinder member coaxially supported for rotation within said sleeve, first tumbler mechanisms, said first tumbler mechanisms including a plurality of holes at a common axial position and circumferentially spaced within at least the inner peripheral surface of said sleeve, said cylinder member including a number of circumferentially spaced axially extending bottomed holes at positions corresponding to the radial holes within said sleeve, radial holes within said cylinder member open to said axial holes at the same axial position as said radial holes of said sleeve, a biasing spring inserted into the bottom of each of said axially extending bottomed holes, a corresponding number of tumbler pins formed with a notch at a different axial position thereon and respectively inserted into said axially extending bottomed holes of said cylinder member, a ball of a diameter less than the diameter of radial holes within said cylinder member and of a diameter larger than the radial holes within said sleeve and received within each radial hole of said cylinder member, whereby, in a normal state, said balls engage said holes of said sleeve and are partially received within the radial holes of said cylinder member to prevent relative rotation between said cylinder member and said sleeve, and second parallel tumbler mechanisms carried by said cylinder radially interior of said first tumbler mechanisms and extending parallel to the axis of said cylinder member and operatively engaging said hollow cylinder member and said sleeve such that by inserting a key into said lock and turning it, said balls are shifted radially into said notches of said tumbler pins of said first parellel tumbler mechanisms and disengaged from said holes of said sleeve to permit relative rotation of said cylinder member and said sleeve, while said second parallel tumbler mechanisms are shifted longitudinally to release said cylinder member from said sleeve.

3. A tumbler lock comprising:

a hollow cylinder casing, a sleeve concentrically mounted within said hollow cylinder casing and secured thereto, a first cylinder member coaxially mounted within said sleeve for rotation about its axis relative to said sleeve, a second cylinder member concentrically mounted within said sleeve and fixed thereto in abutment with said first cylinder member, a plurality of first tumbler mechanisms forming a circumferentially spaced array within said first cylinder member and including longitudinally shiftable tumbler pins and means responsive to a shift in axial position of said pins for selectively locking said first cylinder member to said sleeve to prevent relative rotation of said first cylinder member with respect to said sleeve, and a plurality of second tumbler mechanisms forming a circumferential array radially inward of said first tumbler mechanisms and including axially longitudinally shiftable tumbler pins slidably mounted within said second cylinder member for partial projection within said first cylinder member and means responsive to insertion of the key into the lock and turning of it to cause longitudinal shifting of tumbler pins of respective first and second tumbler mechanisms to release said radial locking means between said first tumbler mechanisms and said sleeve and the axial locking means between said first and second cylinder members to permit relative rotation of said first cylinder member and said sleeve.

4. The tumbler lock as claimed in claim 3, wherein said sleeve includes a plurality of circumferentially spaced radial holes at a common axial position at least within the inner peripheral surface thereof, said first cylinder member includes a corresponding number of radially extending, circumferentially spaced holes of somewhat larger diameter and at axial positions corresponding to the radial holes of said sleeve, said first cylinder member includes radially inner and radially outer arrays of circumferentially spaced longitudinally extending holes, said outer array of holes bottoming within said first cylinder member, said second cylinder member including a circumferential array of bottomed holes axially aligned with and at corresponding circumferential positions to said inner array of holes within said first cylinder member and being of a corresponding diameter, biasing springs within the bottomed holes of said first and second cylindrical members, single tumbler pins slidably mounted within the bottom holes of said first cylinder member and being biased axially towards the key insertion end of said lock, paired tumbler pins being slidably carried within the aligned longitudinal holes of said first and second cylinder members and being biased by said springs toward the key insertion end of said lock, stop means for limiting axial movement of said tumbler pins under the bias of said springs said tumbler pin of said first tumbler mechanism including annular grooves at different axial positions thereon and a ball of a diameter slightly larger than the diameter of the radial holes of the cylinder member and slightly smaller than the diameter of the radial holes of said sleeve being carried within each radial hole of said cylinder member and being normally partially projected into the hole of said sleeve to prevent rotation of said cylinder member relative to said sleeve such that by inserting a key into said lock and turning it, the balls are shifted into the annular groove of said first tumbler pin and are disengaged from the holes of said sleeve, and the pairs of second tumbler pins are shifted axially within the aligned holes receiving said pairs of pins of said first and second cylinder members to premit relative rotation of said first cylinder member relative to said second cylinder member and said sleeve.

* * * * *